US006414249B1

(12) United States Patent
Vickers

(10) Patent No.: US 6,414,249 B1
(45) Date of Patent: Jul. 2, 2002

(54) REDUCTION OF THE PROBABILITY OF INTERLEVEL OXIDE FAILURES BY MINIMIZATION OF LEAD OVERLAP AREA THROUGH BUS WIDTH REDUCTION

(75) Inventor: Kenneth G. Vickers, Whitesboro, TX (US)

(73) Assignee: Texas Instruments Incorporated, Dallas, TX (US)

( * ) Notice: Subject to any disclaimer, the term of this patent is extended or adjusted under 35 U.S.C. 154(b) by 1013 days.

(21) Appl. No.: 08/728,878

(22) Filed: Oct. 10, 1996

Related U.S. Application Data

(62) Division of application No. 08/402,596, filed on Mar. 13, 1995, now Pat. No. 5,598,057.

(51) Int. Cl.[7] ..... H01R 9/09

(52) U.S. Cl. ..... 174/261; 174/250; 361/794

(58) Field of Search ..... 361/780, 748, 361/792, 794; 174/250, 255, 261

(56) References Cited

U.S. PATENT DOCUMENTS 3,755,704 A 8/1973 Spindt et al. ..... 313/309
4,586,105 A * 4/1986 Lippmann et al. ..... 361/117
4,857,799 A 8/1989 Spindt et al. ..... 313/495
4,940,916 A 7/1990 Borel et al. ..... 313/306
4,999,762 A * 3/1991 Sakamoto et al. ..... 363/144
5,194,780 A 3/1993 Meyer ..... 315/169.3
5,225,820 A 7/1993 Clerc ..... 345/55
5,251,108 A * 10/1993 Doshita ..... 361/792
5,436,410 A * 7/1995 Jain et al. ..... 174/256
5,544,018 A * 8/1996 Sommerfeldt et al. ..... 361/792

* cited by examiner

*Primary Examiner*—Kamand Cuneo
(74) *Attorney, Agent, or Firm*—Rose Alyssa Keagy; Wade James Brady, III; Frederick J. Telecky, Jr.

(57) ABSTRACT

A field emission display apparatus has an emitter plate 2 having a plurality of column conductors 9 intersecting a plurality of row conductors 6, and electron emitters 5 at the intersection of each of the row and column conductors. An anode plate 62 is adjacent to the emitter plate 2, the anode plate 62 comprising conductive stripes 50 which are alternately covered by material luminescing in the three primary colors. The conductive stripes 50 covered by the same luminescent material are electrically interconnected to form comb-like structures corresponding to each of the colors. The anode plate 62 contains an active region 58 and the buses 82, 84, 86 have a non-uniform width.

2 Claims, 7 Drawing Sheets

REDUCTION OF THE PROBABILITY OF INTERLEVEL OXIDE FAILURES BY MINIMIZATION OF LEAD OVERLAP AREA THROUGH BUS WIDTH REDUCTION

RELATED APPLICATION

This is a division, of application Ser. No. 08/402,596 filed Mar. 13, 1995 now U.S. Pat. No. 5,598,057.

This application includes subject matter which is related to U.S. patent application Ser. No. 5,598,057, "Field Emission Display Having Modified Anode Stripe Geometry," filed Mar. 13, 1995.

TECHNICAL FIELD OF THE INVENTION

The present invention relates generally to integrated circuit layout and semiconductor electronics, and more particularly to multi-level metal technology and the reduction of the probability of interlevel oxide failures through a modified bus design.

BACKGROUND OF THE INVENTION

The phenomenon of field emission was discovered in the 1950's, and extensive research by many individuals has developed the technology to the extent that its use in inexpensive, low-power, high-resolution, high-contrast, full-color flat displays appears promising. Advances in field emission device ("FED") display technology are disclosed in U.S. Pat. No. 3,755,704, "Field Emission Cathode Structures and Devices Utilizing Such Structures," issued Aug. 28, 1973, to C. A. Spindt et al.; U.S. Pat. No. 4,940,916, "Electron Source with Micropoint Emissive Cathodes and Display Means by Cathodoluminescence Excited by Field Emission Using Said Source," issued Jul. 10, 1990 to Michel Borel et al.; U.S. Pat. No. 5,194,780, "Electron Source with Microtip Emissive Cathodes," issued Mar. 16, 1993 to Robert Meyer; and U.S. Pat. No. 5,225,820, "Microtip Trichromatic Fluorescent Screen," issued Jul. 6, 1993, to Jean-Frédéric Clerc. These patents are incorporated by reference into the present application.

A FED flat panel display arrangement is disclosed in U.S. Pat. No. 4,857,799, "Matrix-Addressed Flat Panel Display," issued Aug. 15, 1989, to Charles A. Spindt et al., incorporated herein by reference. This arrangement includes a matrix array of individually addressable light generating means of the cathodoluminescent type having electron emitting cathodes combined with an anode which is a luminescing means of the CRT type which reacts to electron bombardment by emitting visible light. Each cathode is itself an array of thin film field emission cathodes on a backing plate, and the luminescing means is provided as a phosphor coating on a transparent face plate which is closely spaced to the cathodes.

The emitter backing plate disclosed in the Spindt et al. ('799) patent includes a large number of parallel vertical conductive cathode electrodes which extend across the backing plate and are individually addressable. A multiplicity of spaced-apart electron emitting tips project upwardly from each vertical cathode electrode on the backing plate and extend perpendicularly away from the backing plate. An electrically conductive gate electrode arrangement is positioned adjacent to the tips to generate and control the electron emission. The gate electrode arrangement comprises a large number of individually addressable, parallel horizontal electrode stripes which extend along the backing plate orthogonal to the cathode electrodes, and which include apertures through which emitted electrons may pass. Each gate electrode is common to a full row of pixels extending across the front face of the backing plate and is electrically isolated from the arrangement of cathode electrodes. The emitter back plate and the anode face plate are parallel and spaced apart.

The anode is a thin film of an electrically conductive transparent material, such as indium tin oxide, which covers the interior surface of the face plate. Deposited onto this metal layer is a luminescent material, such as phosphor, that emits light when bombarded by electrons.

The array of emitting tips are activated by addressing the orthogonally related cathode gate electrodes in a generally conventional matrix-addressing scheme. The appropriate cathode electrodes of the display along a selected stripe, such as along one column, are energized while the remaining cathode electrodes are not energized. Gate electrodes of a selected stripe orthogonal to the selected cathode electrode are also energized while the remaining gate electrodes are not energized, with the result that the emitting tips of a pixel at the intersection of the selected cathode and gate electrodes will be simultaneously energized, emitting electrons so as to provide the desired pixel display.

The Spindt et al. patent teaches that it is preferable that an entire row of pixels be simultaneously energized, rather than energization of individual pixels. According to this scheme, sequential lines are energized to provide a display frame, as opposed to sequential energization of individual pixels in a raster scan manner.

The Clerc ('820) patent discloses a trichromatic FED flat panel display having a first substrate comprising the cathode and gate electrodes, and having a second substrate facing the first, including regularly spaced, parallel conductive stripes comprising the anode electrode. These stripes are alternately covered by a first material luminescing in the red, a second material luminescing in the green, and a third material luminescing in the blue, the conductive stripes covered by the same luminescent material being electrically interconnected.

Today, a conventional FED is manufactured by combining the teachings of many practitioners, including the teachings of the Spindt et al. ('799) and Clerc ('820) patents. Referring initially to FIG. 1, there is shown, in cross-sectional view, a portion of an illustrative FED in which the present invention may be incorporated. In this embodiment, the FED comprises an anode plate 1 having an electroluminescent phosphor coating 3 facing an emitter plate 2, the phosphor coating 3 being observed from the side opposite to its excitation.

More specifically, the FED of FIG. 1 comprises a cathodoluminescent anode plate 1 and an electron emitter (or cathode) plate 2. A cathode portion of emitter plate 2 includes conductors 9 formed on an insulating substrate 10, an electrically resistive layer 8 which is formed on substrate 10 and overlaying the conductors 9, and a multiplicity of electrically conductive microtips 5 formed on the resistive layer 8. In this example, the conductors 9 comprise a mesh structure, and microtip emitters 5 are configured as a matrix within the mesh spacings. Microtips 5 take the shape of cones which are formed within apertures through conductive layer 6 and insulating layer 7.

A gate electrode comprises the layer of the electrically conductive material 6 which is deposited on the insulating layer 7. The thicknesses of gate electrode layer 6 and insulating layer 7 are chosen in such a way that the apex of each microtip 5 is substantially level with the electrically conductive gate electrode layer 6. Conductive layer 6 may be in the form of a continuous layer across the surface of substrate 10; alternatively, it may comprise conductive bands across the surface of substrate 10.

Anode plate 1 comprises a transparent, electrically conductive film 12 deposited on a transparent planar support 13, such as glass, which is positioned facing gate electrode 6 and parallel thereto, the conductive film 12 being deposited on the surface of the glass support 13 directly facing gate electrode 6. Conductive film 12 may be in the form of a continuous layer across the surface of the glass support 13; alternatively, it may be in the form of electrically isolated stripes comprising three series of parallel conductive bands across the surface of the glass support 13, as shown in FIG. 1 and as taught in U.S. Pat. No. 5,225,820, to Clerc. By way of example, a suitable material for use as conductive film 12 may be indium-tin-oxide (ITO), which is optically transparent and electrically conductive. Anode plate 1 also comprises a cathodoluminescent phosphor coating 3, deposited over conductive film 12 so as to be directly facing and immediately adjacent gate electrode 6. In the Clerc patent, the conductive bands of each series are covered with a particulate phosphor coating which luminesces in one of the three primary colors, red, blue and green $\mathbf{3}_R$, $\mathbf{3}_B$, $\mathbf{3}_G$.

Selected groupings of microtip emitters 5 of the above-described structure are energized by applying a negative potential to cathode electrode 9 relative to the gate electrode 6, via voltage supply 19, thereby inducing an electric field which draws electrons from the apexes of microtips 5. The potential between cathode electrode 9 and gate electrode 6 is approximately 70–100 volts. The freed electrons are accelerated toward the anode plate 1 which is positively biased by the application of a substantially larger positive voltage from voltage supply 11 coupled between the cathode electrode 9 and conductive film 12 functioning as the anode electrode. The potential between cathode electrode 9 and anode electrode 12 is approximately 300–800 volts. Energy from the electrons attracted to the anode conductive film 12 is transferred to particles of the phosphor coating 3, resulting in luminescence. The electron charge is transferred from phosphor coating 3 to conductive film 12, completing the electrical circuit to voltage supply 11. The image created by the phosphor stripes is observed from the anode side which is opposite to the phosphor excitation, as indicated in FIG. 1.

It is to be noted and understood that true scaling information is not intended to be conveyed by the relative sizes and positioning of the elements of anode plate 1 and the elements of emitter plate 2 as depicted in FIG. 1. For example, in a typical FED shown in FIG. 1 there are approximately one hundred arrays 4, of microtips and there are three color stripes $\mathbf{3}_R$, $\mathbf{3}_R$, $\mathbf{3}_G$ per display pixel.

The process of producing each frame of a display using a typical trichromatic field emission display includes a) applying an accelerating potential to the red anode stripes while sequentially addressing the gate electrodes (row lines) with the corresponding red video data for that frame applied to the cathode electrodes (column lines); b) switching the accelerating potential to the green anode stripes while sequentially addressing the rows lines for a second time with the corresponding green video data for that frame applied to the column lines; and c) switching the accelerating potential to the blue anode stripes while sequentially addressing the row lines for a third time with the corresponding blue video data for that frame applied to the column lines. This process is repeated for each display frame.

FIG. 2 is a block diagram of a portion of a field emission display electronics system as disclosed in U.S. patent application Ser. No. 08/332,182, "Field Emission Device Automatic Anode Voltage Adjuster," filed Oct. 31, 1994(Texas Instruments, Inc. Docket No. TI-19620), incorporated herein by reference. As indicated in FIG. 2, anode plate 1 is physically located over emitter plate 2; however, anode plate 1 and emitter plate 2 are separated in the drawing in order to better show the elements comprising plates 1 and 2 of the FED display. Elements which are part of the system but which are unimportant to the understanding of the field emission display are not shown.

Anode power supply 20 provides a high voltage source to an anode switching control 22, typically between 300 and 800 volts. The anode voltage switching control 22, responsive to commands issued from data formatting and timing controller 24, provides voltages simultaneously (if the image is in monochrome) or sequentially (if the image is in color) to the three anode stripes $\mathbf{3}_R$, $\mathbf{3}_G$ and $\mathbf{3}_B$, each of the anode stripe voltages being set to a level in accordance with the brightness characteristics of the corresponding luminescent material.

The cathode electrodes 9 (column lines) of matrix-addressable cathode emitter plate 2 are individually coupled to column drivers 26. The column drivers 26 receive video data from a host device, which has been formatted by the data formatter and timing controller 24 into separate red, green, and blue display frames from an original mixed signal. In this example, the data formatter and timing controller 24 may process the video data according to the VGA standard, and may typically output data to the column drivers 26 for output on 640 parallel lines, to thereby provide one color component of a single row of the display. The data from the data formatter and timing controller 24 is latched into the column drivers 26 upon each occurrence of a clock signal received at the CLK input terminal.

The gate electrodes 6 (row lines) of matrix-addressable cathode plate 2 are individually coupled to row drivers 28. The row drivers 28 receive enable signals from row address counter/decoder 30. The device 30 includes a counter which is responsive to each occurrence of a clock signal received at a CLK input terminal, and a decoder which applies an enabling signal sequentially to each of the row drivers 28. In this example, the counter of the device 30 may count to 480, the decoder portion of the device 30 applying enabling signals sequentially to each of the row drivers-28, to thereby address each of the 480 output lines.

The data formatter and timing controller 24 also receives a synchronization input signal from the host. The sync input contains the clock, horizontal sync, and vertical sync information.

The data formatter and timing controller 24 is coupled to frame memory 32. The memory 32 holds the luminance information corresponding to two red pixels, two green pixels and two blue pixels. For illustration purposes, memory 32 comprises 307,200 words of 12-bit length, which is the capacity necessary to store two full frames of six bits of luminance information for each pixel of a 640-column by 480-row display system.

In accordance with a field sequential mode of operation, an entire frame of red luminance information is first clocked out of the memory 32. After an entire frame of red luminance information has been transferred from the memory 32 a similar process is repeated for an entire frame of green luminance information, and thereafter for an entire frame of blue luminance information. This entire process is repeated continuously while an image is displayed by the FED. The eye is a slow detector compared with the frame time and the perception of the full color is due to an averaging effect over several image frames. Therefore, the color sensation perceived by a person viewing the FED is due to a reconstitution of the colored spectrum by the viewer's eye.

As indicated in FIG. 2, all red stripes $\mathbf{3}_R$ are electrically coupled together. All green stripes $\mathbf{3}_G$ and all blue stripes $\mathbf{3}_B$ are also electrically coupled to each other. The prior art structure used to facilitate the electrical interconnection of the color anode stripes $\mathbf{3}_R$, $\mathbf{3}_G$, and $\mathbf{3}_B$, is shown in FIGS. 3 and 4. FIG. 3 shows the manner in which the conductive film 34 of the anode stripes 34 are interconnected in the prior art. The conductive films 34 are substantially similar to the conductive film 12 of FIG. 1. Conductive film $\mathbf{34}_R$ is covered with a phosphor coating luminescing in red, conductive film $\mathbf{34}_B$ is covered with a phosphor coating luminescing in blue, and conductive film $\mathbf{34}_G$ is covered with a phosphor coating luminescing in green.

The conductive films $\mathbf{34}_R$ are electrically interconnected by a first conductive band 36. The conductive films $\mathbf{34}_G$ are electrically interconnected by a second conductive band 38. The conductive films $\mathbf{34}_B$ are electrically interconnected by a anisotropic conductive ribbon 40 described more fully below. The first and second conductive bands 36, 38 are formed on the anode plate 1 during the at the same time the conductive films 34 are formed. The conductive bands 36, 38 and the conductive films 34 are also coplanar and both are comprised of the same conductive material, illustratively indium-tin-oxide (ITO).

The conductive films $\mathbf{34}_R$ which are connected to band 36 are interdigitated with the conductive films $\mathbf{34}_G$ which are connected to band 38 and the conductive films $\mathbf{34}_B$, which are connected to band 40. The anisotropic conductive ribbon 40 is deposited perpendicular to the conductive films 34.

FIG. 4 shows a section of the anode plate 1 along the anisotropic conductive ribbon 40. The anisotropic ribbon 40 is essentially formed by a conductive strip 40" and a film 40'. The film 40' comprises carbide balls 42 distributed in an insulating binder forming the film 40', so as not to conduct electricity. As can be seen from FIG. 4, the conductive strip 40" crushes the film 40' at the conductive films $\mathbf{34}_B$. The density of the balls 42 is such that at the crushed points the balls 42 are in contact. The ribbon 40 becomes conductive at these points. The conductive films $\mathbf{34}_B$ are electrically connected to the conductive ribbon 40", but the non-crushed locations of film 40' are insulating.

There are numerous disadvantages to the prior art structure used to interconnect the red, green, and blue anode stripes. First, the use of the externally attached anisotropic ribbon 40 to connect the conductive films $\mathbf{34}_B$, creates a significant FED system reliability problem. If the ribbon 40 isn't assembled to anode plate 1 properly then the conductive films 34 of two or three colors will be shorted together. Furthermore, the ribbon 40 can become disconnected from the conductive films $\mathbf{34}_B$ causing lines to appear in the display image at the places where the conductive films $\mathbf{34}_B$, are not electrically connected to the ribbon 40.

What is needed is an alternative structure to the external conductive ribbon, and a multilevel metal structure which has a lowered probability of interlevel oxide failures. More ideally, what is needed is a bus structure which has a reduced failure rate.

SUMMARY OF THE INVENTION

A field emission display apparatus is comprised of an emitter plate comprising a plurality of column conductors intersecting a plurality of row conductors, and electron emitters at the intersection of each of the row and column conductors. An anode plate is adjacent to the emitter plate, the anode plate comprising conductive stripes which are alternately covered by materials luminescing in the three primary colors. The conductive stripes covered by the same luminescent material are electrically interconnected to form comb-like structures corresponding to each of the colors. The anode plate contains an active region and the buses have a non-uniform width.

The use of the step-wise width incrementing bus structure, as disclosed herein, has numerous advantages including the reduction in failure rate of the insulator between the bus and overlying or underlying conductors. First, the reduction in failure rate realized by the step-wise bus structure of the present invention is supplemental to any other techniques used to reduce the failure rate of DLM designs such as increasing the metal thickness to reduce metal width. In addition, implementation of the step-wise bus structure is cost-free; no extra design or manufacturing costs are incurred by implementing the present invention. Furthermore, the implementation of the present invention improves reliability by approximately 96.7%, resulting in significant cost savings.

BRIEF DESCRIPTION OF THE DRAWINGS

The foregoing features of the present invention may be more fully understood from the following detailed description, read in conjunction with the accompanying drawings, wherein.

DETAILED DESCRIPTION

Figure 5:
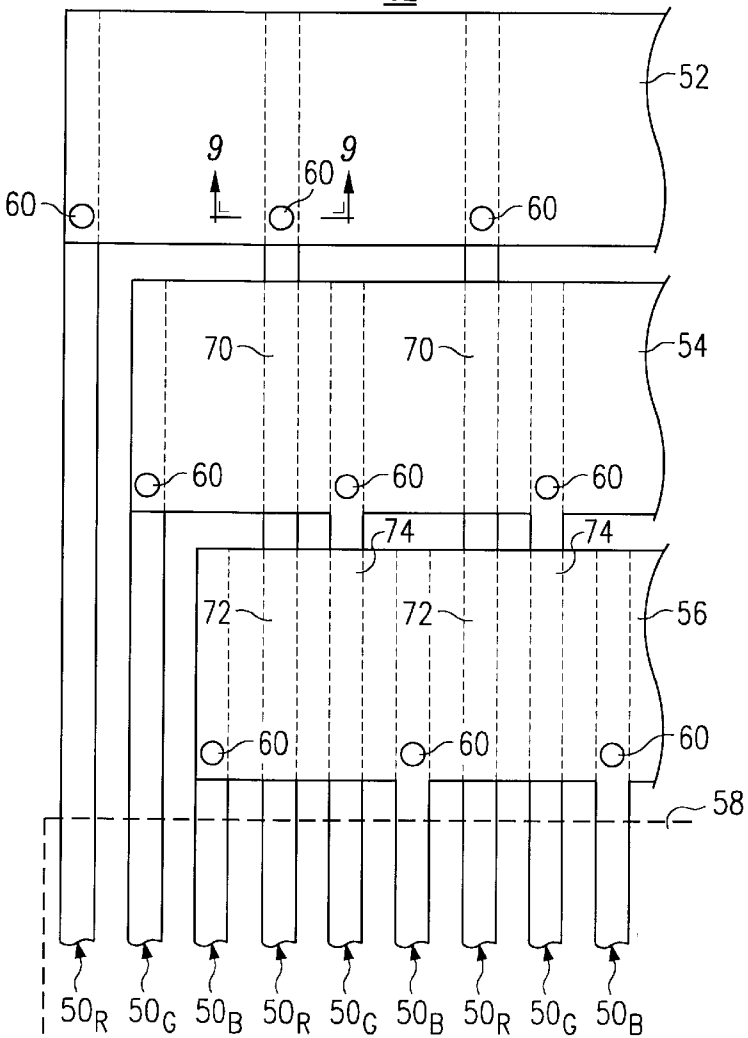
FIG. 5 is a top view of an arrangement of the conductive stripes and buses of the anode plate using double level metal techniques.

One technique for improving the reliability of the anode plate in an FED by eliminating the use of the externally attached ribbon is to design the anode plate using Double Level Metal (DLM) techniques. FIG. 5 is a top view of an arrangement of the conductive stripes and buses of the anode plate using double level metal techniques. As shown in FIG. 5, all red anode stripes $\mathbf{50}_R$ are electrically interconnected to red color bus 52, all green anode stripes $\mathbf{50}_G$ are electrically interconnected to green color bus 54, and all blue anode stripes $\mathbf{50}_B$ are electrically interconnected to blue color bus 56. Using this structure for the FED anode plate design, the anode stripes 50 would be 227$\mu$ wide. Since the application requires 227$\mu$ wide anode stripes, the layout engineer would typically make the width of the buses 52, 54, 56 227$\mu$ wide also. This bus width would be chosen because it would be easy to design and because it easily accommodates the current and voltage drop requirements of the buses. Furthermore, a bus width of 227$\mu$ would be selected because the layout engineer would not want to make the bus width smaller than the anode stripe width and thereby unnecessarily restrict the diameter of the via 60.

The region in which the charged electrons from the cathode plate travel to the anode stripes, thereby energizing the color phosphors and creating the color display image, is called the active display region 58. The buses 52, 54, and 56, as well as the interconnections between the buses and the anode stripes 50 occur outside the active area 58.

Anode stripes 50 are interconnected to buses 52, 54, and 56 through vias 60 using the DLM structure described in more detail below. Even though every red, green, and blue anode stripe $\mathbf{50}_R$, $\mathbf{50}_G$, $\mathbf{50}_B$ is connected to their respective red, green and blue bus, FIGS. 5, 10, 11, 12, and 13 illustrate only a representative portion of the total anode stripe and anode bus structure.

Figure 1:
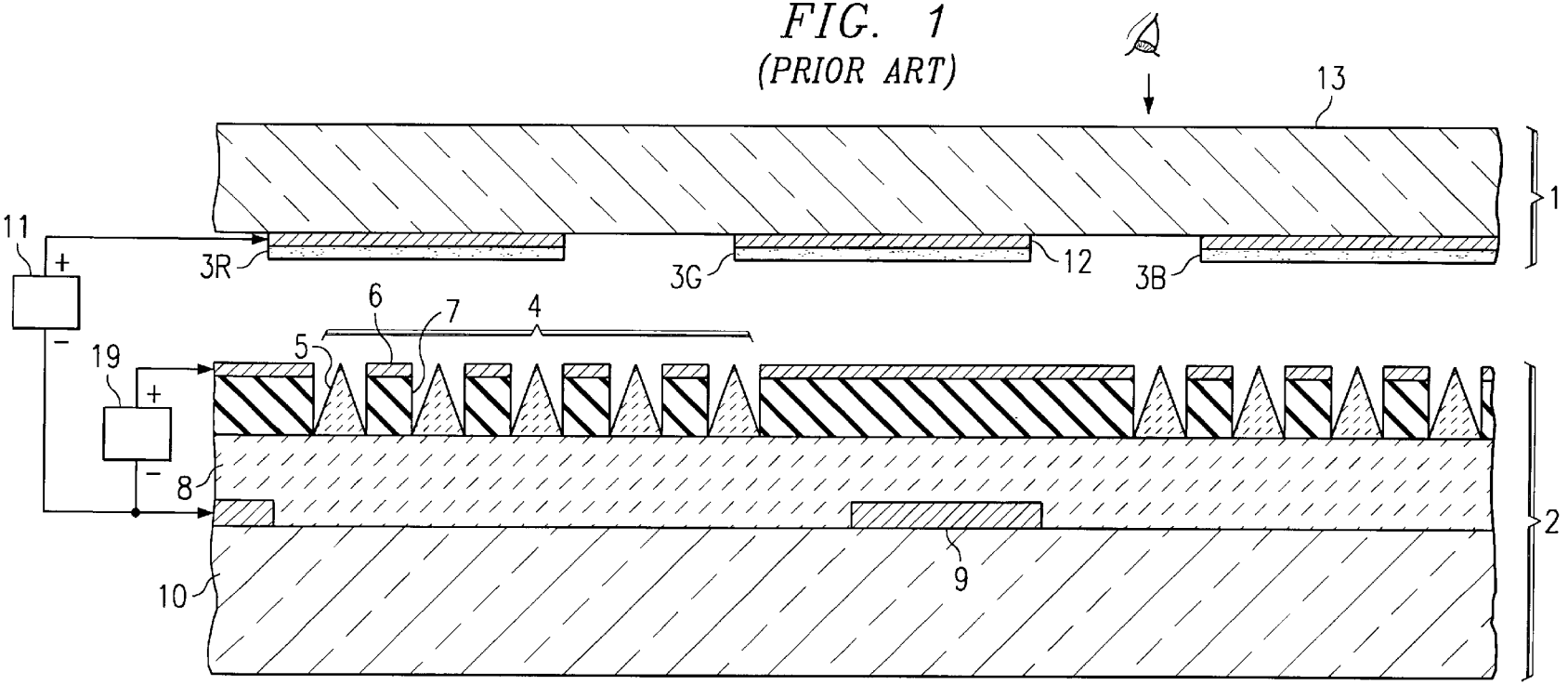
FIG. 1 (PRIOR ART)
FIG. 1 is a cross-sectional view of a portion of a field emission device according to the prior art.
Figure 2:
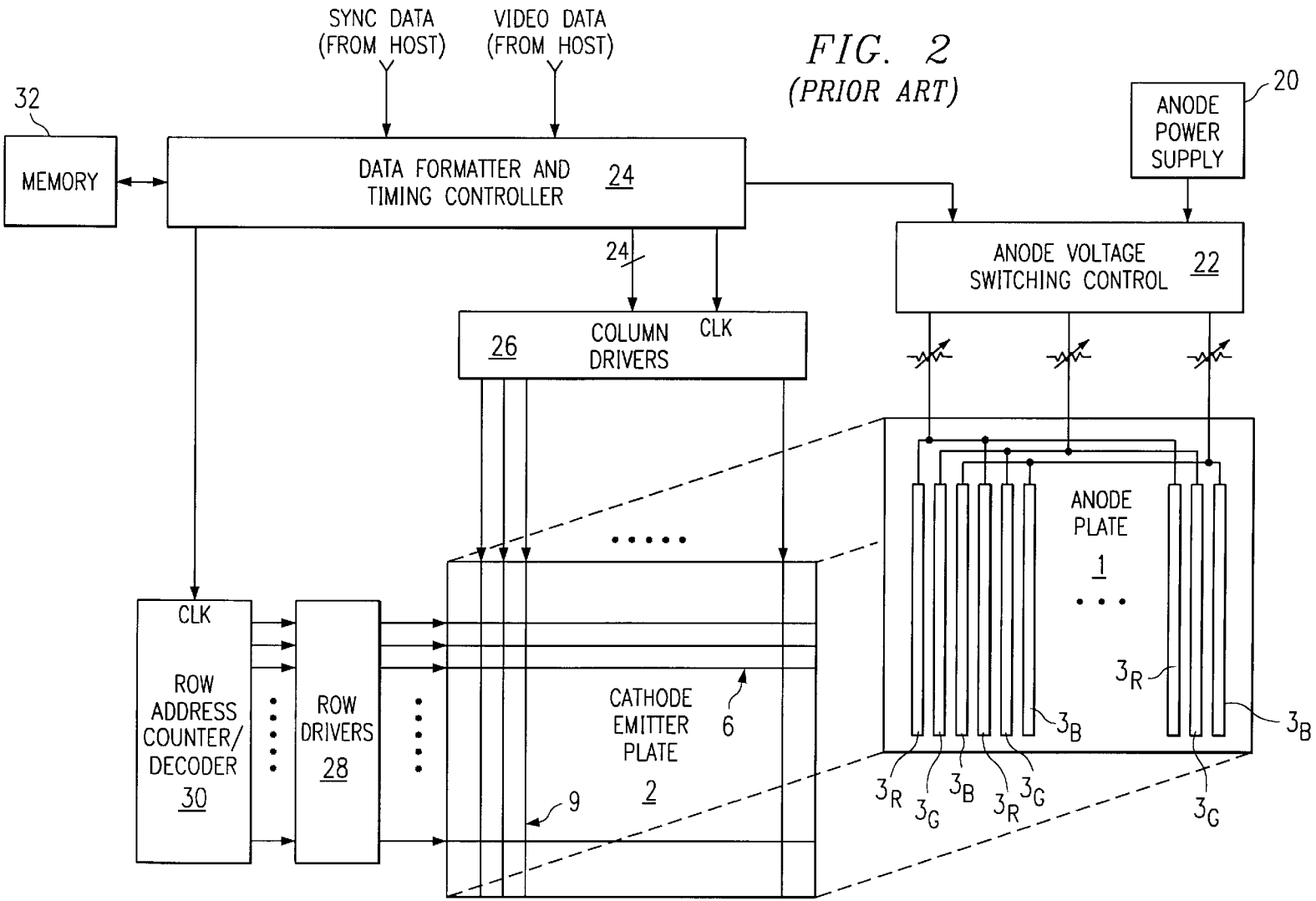
FIG. 2 (PRIOR ART)
FIG. 2 is a block diagram of a portion of a field emission display electronics system according to the prior art.
Figure 3:
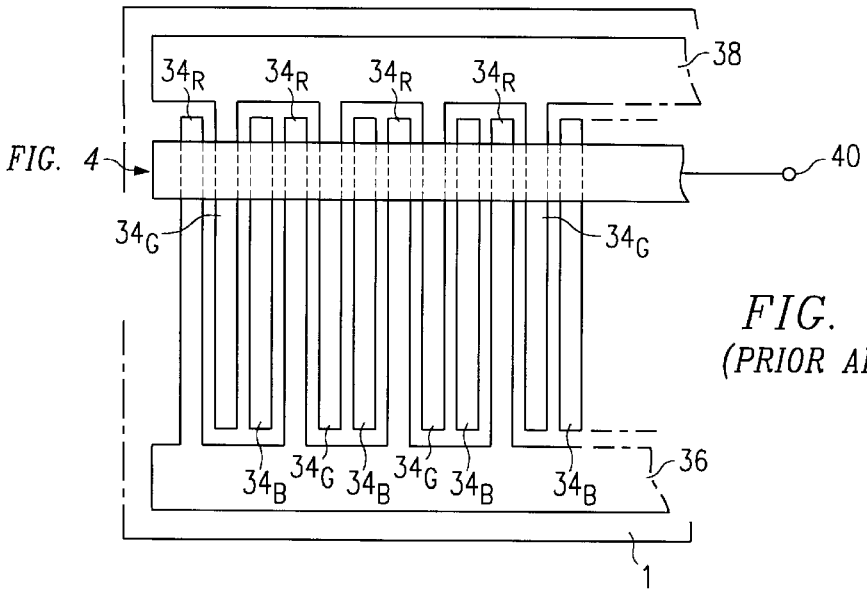
FIG. 3 (PRIOR ART)
FIG. 3 is a top view of the arrangement of conductive bands according to the prior art.
Figure 4:
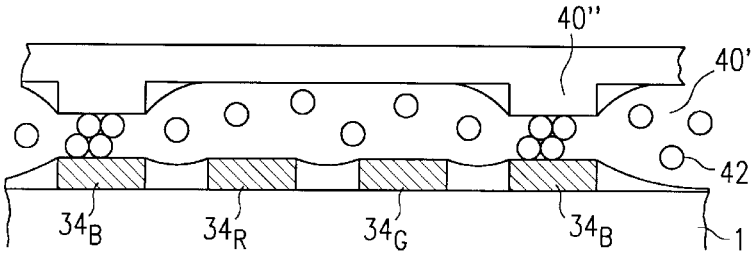
FIG. 4 (PRIOR ART)
FIG. 4 is a cross-sectional view of a conductive band of FIG. 3 according to the prior art.
Figure 6:
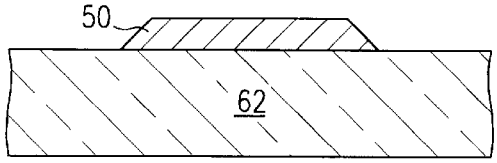
FIGS. 6 through 9 illustrate steps in a process for fabricating the double level metal structure of the present invention.

A typical method for manufacturing the anode plate using the DLM process is as follows. The glass anode face plate (550 mm by 650 mm by 1.1 mm thick) is purchased with a layer of ITO which is 0.1 $\mu$ thick. A layer of photoresist, illustratively type AZ-1350J sold by Hoescht-Celanese of Somerville, N.J., is spun on over the ITO layer to a thickness of approximately 1$\mu$. Next, a patterned mask is disposed over the light-sensitive photoresist layer. The mask exposes desired regions of the photoresist to light. The mask used in this step defines anode stripes 50 which have a width of approximately 227$\mu$. The exposed regions are removed during the developing step, which may consist of soaking the assembly in a caustic or basic chemical such as Hoescht-Celanese AZ developer. The developer removes the unwanted photoresist regions which were exposed to light. The exposed regions of the ITO layer are then removed, typically by a reactive ion etch (RIE) process using carbon tetraflouride ($CF_4$). The remaining photoresist layer is removed by a wet strip process using commercial organic strippers or plasma ashing, leaving the structure shown in FIG. 6. The portions of ITO which remain on anode plate 62 are anode stripes 50.

Figure 7:
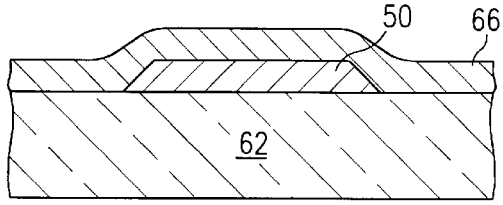
Figure 8:
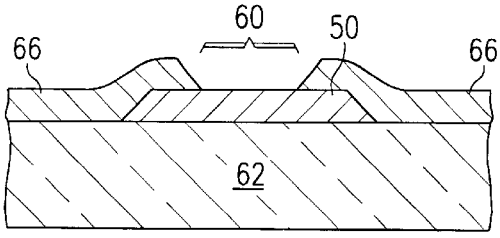

An insulating layer 66 of spin-on-glass (SOG) now is applied over the entire anode plate to a thickness of 1.5$\mu$, as shown in FIG. 7. Alternatively, the insulative layer 66 could be amorphous silicon dioxide or other types of insulating films which is deposited by a chemical vapor deposition (CVD) process. The insulating layer is called the interlevel oxide layer (ILO). A layer of photoresist is again applied, a mask defining a 474 mm by 632 mm active region 58, and 200$\mu$ diameter vias 60 (both shown in FIG. 5) is added, and then the photoresist is developed. The unwanted photoresist regions which are exposed to light are removed by soaking the assembly in a caustic or basic chemical, such as Hoescht-Celanese AZ developer. The exposed regions of ILO 66 are then removed by either plasma etch or by a process using $CF_4$, HF, or a combination of both $CF_4$ and HF. The remaining photoresist layer is then removed by a wet strip process using commercial organic strippers or plasma ashing. Via 60 region of the ITO layer 50 is now exposed, as illustrated in FIG. 8.

Figure 9:
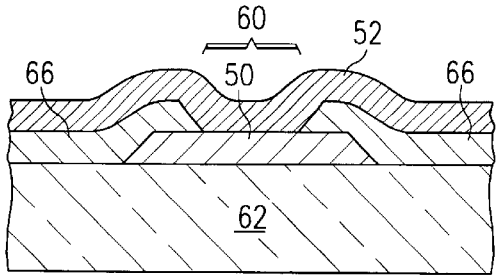

A second conductive layer is formed by a deposition process (for example Al:2% Cu of a thickness of approximately 1$\mu$) over the entire anode plate. A layer of photoresist is spun over the AlCu layer, a patterned mask defining buses 52, 54, 56 (shown in FIG. 5) is then disposed over the light-sensitive photoresist layer. Next, the developing step removes the unwanted photoresist regions which were exposed to light. The exposed regions of the AlCu are then removed, typically using either a plasma or wet chlorine chemistries, which do not harm the previously deposited metal ITO layer. The completed DLM structure is shown in FIG. 9. FIG. 9 shows a cross-sectional view of the anode plate at the via region indicated in FIG. 5. The AlCu bus layer 52 is now electrically interconnected to anode stripe 50 in the via region 60 as a result of the DLM process described. The remaining photoresist layer is removed by a wet strip process using commercial organic strippers or plasma ashing.

Returning to FIG. 5, there are many regions in the anode plate DLM structure where a bus of one color must cross an anode stripe of another color. For example, green bus 54 crosses the red anode stripes in regions 70. Furthermore, blue bus 56 crosses the red anode stripes in regions 72 and crosses the green anode stripes in regions 74. In each cross-over region 70, 72, 74 a bus metal (for example 54) crosses an anode stripe 50 which is connected to a different bus (for example $\mathbf{50}_R$) and the two metal layers are separated only by a layer of ILO 66. If a defect exists in the ILO then a bus of one color will electrically short to an anode stripe of another color. When a bus of a first color shorts to an anode stripe of a second color then color wash occurs as the phosphors of the second material are energized and therefore illuminate during the time that the phosphors of the first color are illuminated.

The problem of color wash caused by a direct short between a anode bus 52, 54, 56 and an anode stripe 50, as described above, contributes to the failure rate of the anode plate during factory test. The dead short may occur for different reasons. For instance, a foreign particle may get lodged in the ILO during deposition. Also, defects in the photoresist my cause defects to be introduced during the ILO etch process.

In addition to the problem of dead shorts, there is another failure mechanism which can occur in the cross-over region and therefore contribute to the failure rate. The additional failure mechanism is an ILO layer which is an insufficient thickness. This failure mechanism unfortunately goes undetected during factory test. When, the thickness of the ILO layer is insufficient for long term operation of the anode plate, the anode plate may operate as designed for an initial period of time and therefore will pass factory test. However, the ILO eventually weakens with time and eventually a crack develops in the ILO. When a crack develops in the ILO, metal travels along the crack and the result is an electrical short between the metal layers.

The term defect density is used to describe all failures caused by defects in the ILO which result in the shorting of the two metal layers. Defect density is measured in terms of defects/$cm^2$. The degree to which the defect density contributes to the overall failure rate of the anode plate is proportional to the amount of cross-over area. In other words, the larger the amount of area where the two metal layers overlap, the greater the amount of ILO area which is depended on to insulate the two metal layers, and therefore the more likely that defects in the ILO layer will cause shorting to the two metal layers. The level of defect density is determined by the machines and process flow used to build a specified product and is generally consistent for that product.

Because of the phenomenon of defect density in cross-over regions, reducing the amount of cross-over area helps control the failure rate. One solution Is to make the buses 52, 54, 56 and stripes 50 thicker and narrower. This design modification will reduce the cross-over area 70, 72, 74. A manufacturing consideration for this modification is that more manufacturing time will be consumed because it will take longer to deposit the metal layers. Furthermore, it will take more manufacturing time to etch the thicker layers. In addition, if a wet etch process is used, an undercutting problem is likely because of the isotropic nature of the wet etch.

Figure 10:
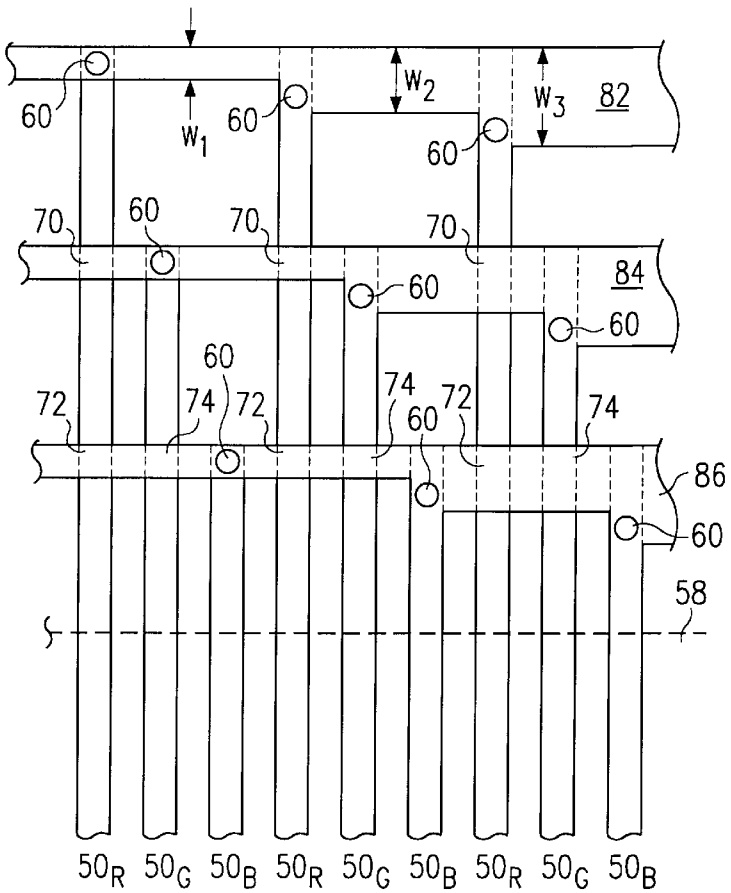
FIG. 10 is a top view of an arrangement of the anode buses and anode stripes in accordance with a first embodiment of the present invention.

FIG. 10 is a top view of the anode plate showing a bus structure for reducing the cross-over area in accordance with the present invention. Anode color stripes 50 and vias 60 shown in FIG. 10 are substantially similar to anode stripes 50 and vias 60 shown in FIG. 5. The anode plate structure of FIG. 10 reduces the cross-over area of regions 70, 72, 74 by giving the red bus 82, the green bus 84 and the blue bus 86 a step-like design.

The anode plate in FIG. 10 is illustratively a 492 mm by 650 mm panel which would be used in applications such as engineering workstations. The width $W_1$, of the red bus 82 is approximately 0.8$\mu$ which is the smallest width printable with current high volume panel printing equipment. The first sixty seven of the total 1024 anode stripes in a large screen FED can be accommodated by the maximum current (at a current density of 200000 A/cm$^2$ for Al:2% Cu) which is carried by this initial $W_1$ width of 0.8$\mu$. The width $W_2$ of the red bus 82 is increased by approximately 0.012$\mu$, which is the increase in width needed to accommodate the current of the additional red anode stripe $\mathbf{50}_R$ added to the red bus 82. Similarly, the width $W_3$ of the red bus 82 is increased by approximately 0.012$\mu$, which is the smallest increase in width needed to accommodate the additional current of the added red anode stripe $\mathbf{50}_R$. Designing the buses 82, 84, 86 in this step-wise manner reduces the cross-over area of regions 70, 72, 74, and therefore reduces the failures caused by defect density of the ILO layer. The reduction in the failure rate realized by the bus structure 82, 84, 86 shown in FIG. 10 is 99.2% as compared to the structure shown in FIG. 5.

In general, for thickness T and maximum operating current density j, the bus width W increments by $\Delta W$ for an increment of current $\Delta I$ due to an anode stripe according to $\Delta W=\Delta I/jT$. Statistical fluctuations in line width imply the increments $\Delta W$ may vary; and increments may be aggregated for convenience.

The use of the step-wise bus structure, as disclosed herein, has numerous advantages. First, the reduction in failure rate realized by the step-wise design of the present invention is supplemental to any other techniques used to reduce the failure rate of DLM designs such as improving the photolithographic processing technique, or increasing the metal thickness to reduce metal width as described above. In addition, implementation of the step-wise bus structure is cost-free; no extra design or manufacturing costs are incurred by implementing the present invention. Furthermore, the implementation of the present invention improves reliability by approximately 99.2% over FIG. 5, resulting in an increased production yield and significant cost savings.

Figure 13:
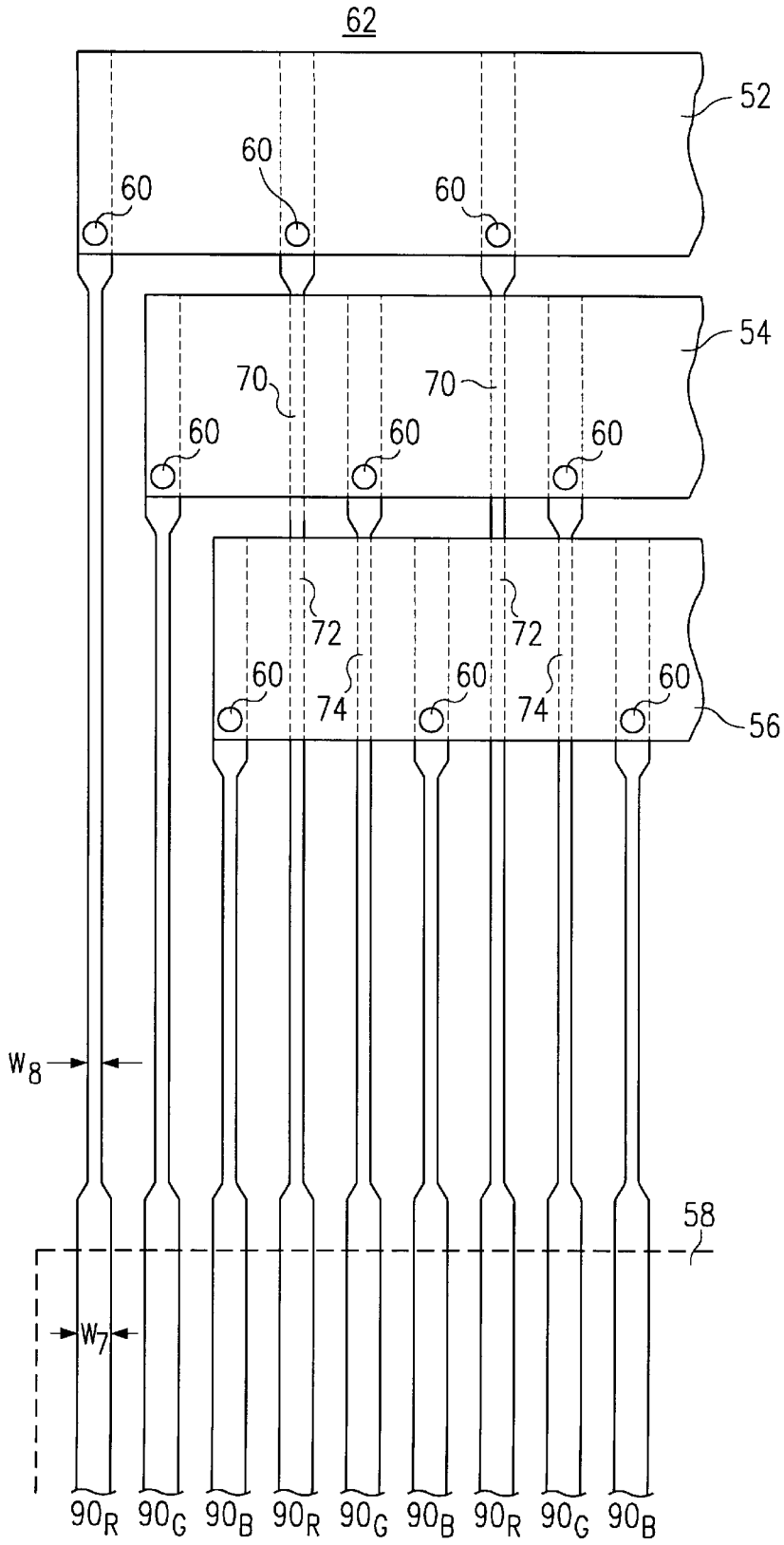
FIG. 13 is a top view of an arrangement of the anode buses and anode stripes in accordance with an alternative embodiment of the present invention.

FIG. 13 is a top view of the anode plate showing the bus structure of FIG. 5 and an anode stripe structure for reducing the cross-over area in accordance with the present invention. The anode buses 52, 54, 56 and the vias 60 shown in FIG. 13 are substantially similar to the buses 52, 54, 56 and the vias 60 shown in FIG. 5. The anode plate structure of FIG. 13 further reduces the cross-over area of regions 70, 72, 74 by narrowing the width of the anode stripes 90 outside of the active region 58.

Figure 11:
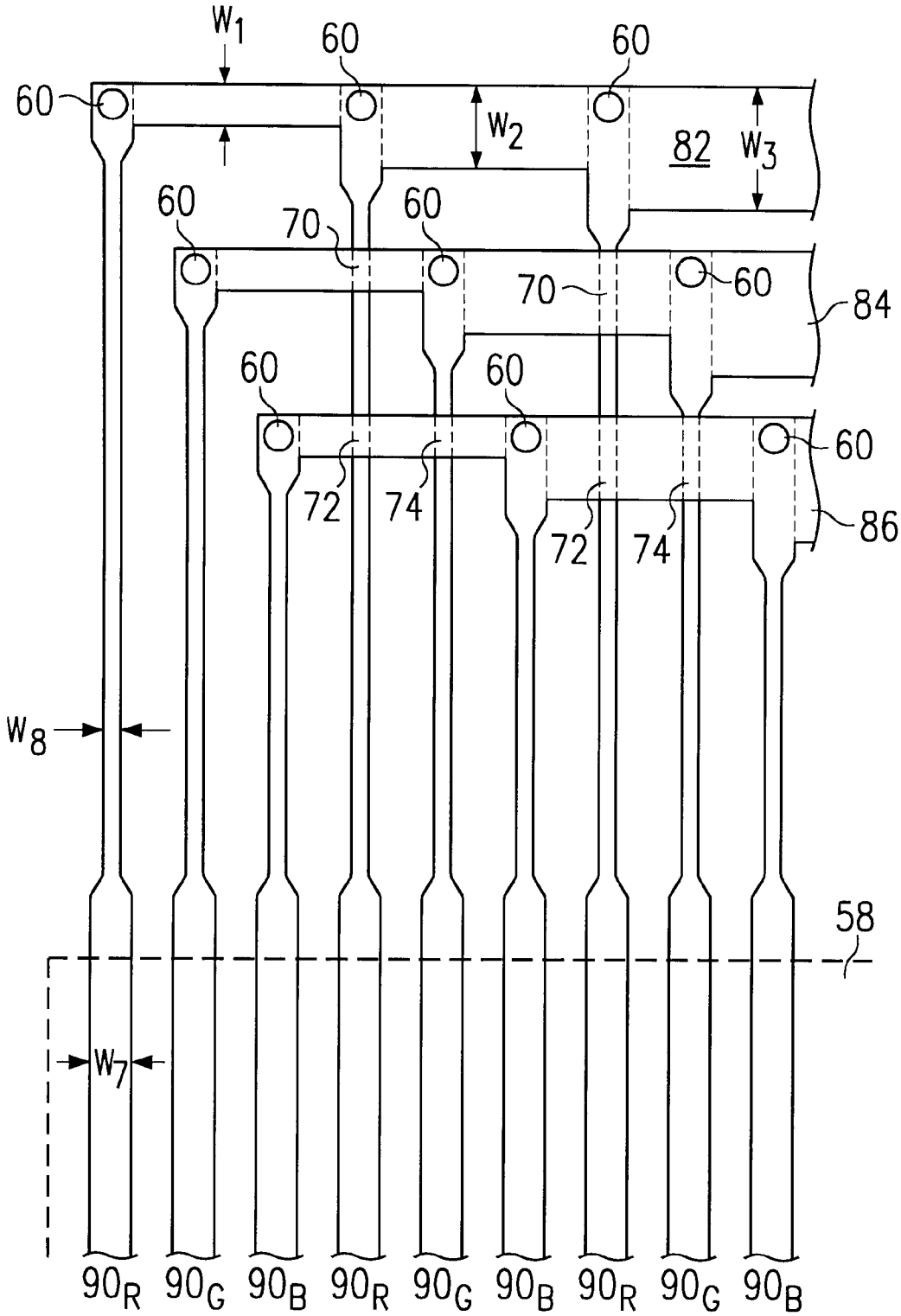
FIG. 11 is a top view of an arrangement of the anode buses and anode stripes in accordance with a second embodiment of the present invention.

The width $W_7$ of anode stripe 90 inside the active region 58 is approximately 227$\mu$. The width of the anode stripe 90 inside the active region 58 is determined by such considerations as composition of luminance material, manufacturing machine capabilities, and luminance parameters required by the system application. As shown in FIG. 11, the anode stripe width $W_8$ outside of the active area can be narrowed to a minimum width so as not to increase the voltage drop outside of the active region above the voltage drop inside the active region. In the present invention, the width $W_8$ is approximately 7.56$\mu$, and this narrow stripe forms a series resistor of approximately 10Ω. This width prevents display luminance non-uniformity problems by assuring that the voltage drop in the stripe 90 material is no greater outside the active area 58 as inside the active area 58.

The width of the anode stripes $\mathbf{90}_R$, $\mathbf{90}_G$, $\mathbf{90}_B$ are increased back to width $W_7$ in the bus regions in order to accommodate a larger via and therefore a more robust electrical interconnection between the anode stripe and the bus. Designing the anode stripes 90 in this manner further reduces the cross-over area of regions 70, 72, 74 by a factor of 7.56/227. Therefore there is a reduction in the failures caused by defect density of the ILO layer by this factor.

Because there are numerous cross-over areas in the entire panel, even a small decrease in width between $W_8$ and $W_7$ can greatly improve the reliability of the anode plate. In the panel of the present invention there are 1023 cross-over areas in the green bus 54 and there are 2046 cross-over areas in the red bus 56. Therefore, even in situations where $W_8$ is only slightly smaller than $W_7$, such as 1$\mu$(which is the minimum design width for a medium resolution printer), a large reduction in failures is realized. The reduction in the failure rate realized by the structure of the anode stripe 90 shown in FIG. 11, as compared to FIG. 5, is 96.7%.

The narrowing of the anode stripe 90 outside the active area 58, as disclosed herein, has numerous advantages. First, the reduction In failure rate realized by the anode stripe design of the present invention is supplemental to any other techniques used to reduce the failure rate of DLM designs such as improving photolithographic processing techniques or increasing the metal thickness to reduce metal width. In addition, implementation of the narrowed anode stripe structure is cost-free; no extra design or manufacturing costs are incurred by implementing the present invention. Furthermore, the implementation of the present invention improves reliability by approximately 96.7%, as compared to the structure shown in FIG. 5, resulting in an increased production yield and significant cost savings.

By combining the step-wise bus structures 82, 84, 86 of FIG. 10 with the narrowed anode stripe structures 90 of FIG. 13, the reduction in cross-over area, as shown in FIG. 11, is approximately 99.97% below the total cross-over area of a standard design, as shown in FIG. 5. As a result, the reduction in the anode plate failure rate caused by the defect density, when using the design of the present invention shown in FIG. 11, is also approximately 99.97%.

Figure 12:
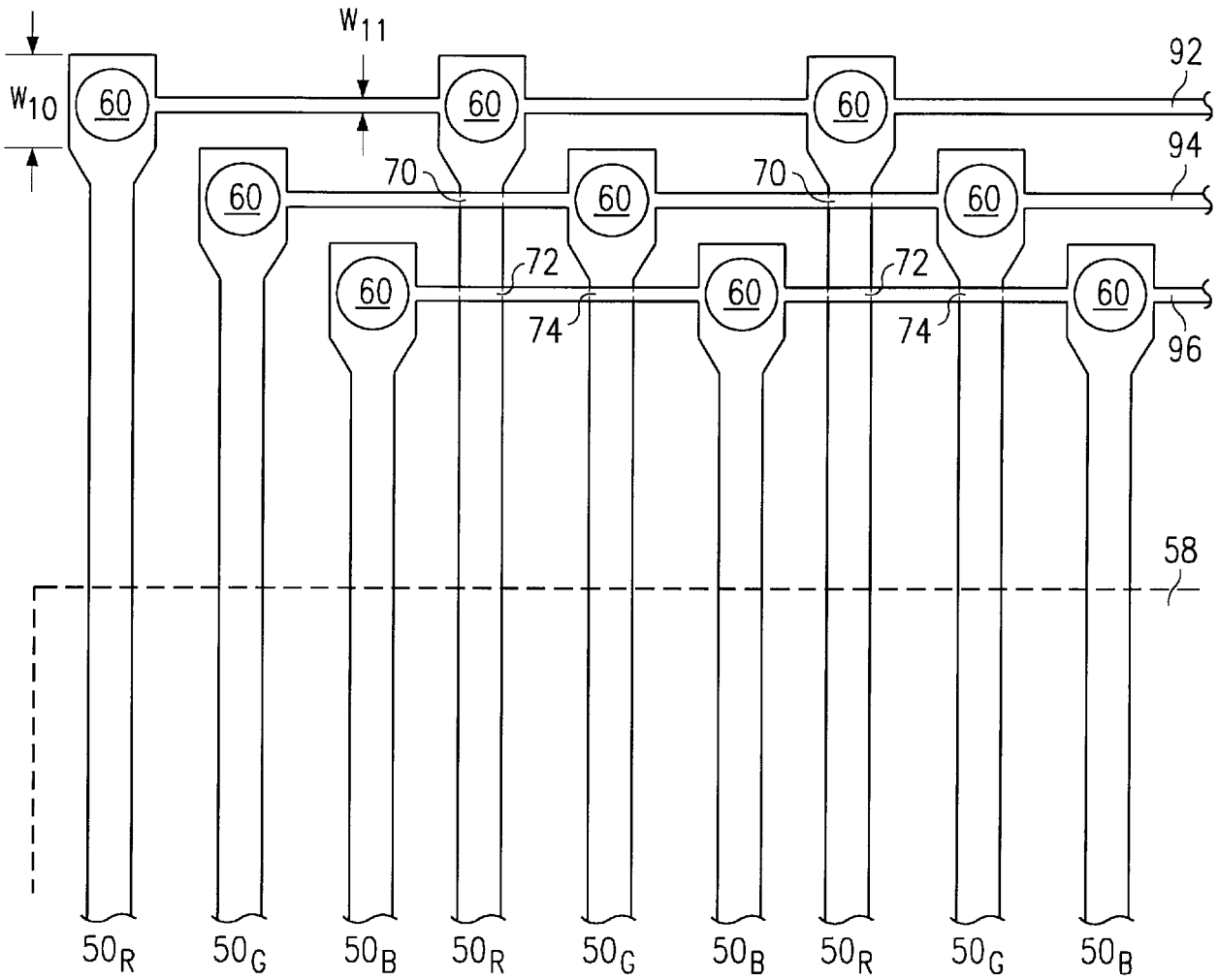
FIG. 12 is a top view of an arrangement of the anode buses and anode stripes in accordance with a third embodiment of the present invention.

There are various alternative bus and anode stripe designs which also reduce the cross-over area and are therefore comprehended by this invention. For example, FIG. 12 shows an alternative bus structure in accordance with the present invention. The anode stripes 50 are substantially similar to the anode stripes shown in FIG. 10. The anode plate structure of FIG. 12 further reduces the cross-over area of regions 70, 72, 74 by narrowing the width of the buses 92, 94, 96 outside the area of vias 60.

In DLM designs where a large via is used to robustly connect the two metal layers, a simplified bus design would be to have a consistent bus width $W_{10}$ which is approximately equal to the via 60 width. The bus structure of FIG. 12 further reduces the cross-over area of regions 70, 72, 74 by narrowing the width of the buses 92, 94, 96 to $W_{11}$, which is the minimum width necessary to accommodate the current density of all anode stripes of one color. In the present invention the width $W_{10}$ of the buses 92, 94, 96 at the via site is 5000 microns, whereas the width $W_{11}$, of the buses between vias is 500 microns.

Several other variations of the above would be understood by one skilled in the art and are considered to be within the scope of the present invention. For example, while the disclosure describes the anode plate as having a DLM structure; other multi-level metal structures such as Triple Level Metal (TLM) can be accommodated. Furthermore, alternative materials used for the metal and insulator layers are comprehended by the present invention.

While the principles of the present invention have been demonstrated with particular regard to the structures and methods disclosed herein, it will be recognized that various departures may be undertaken in the practice of the invention. The scope of the invention is not intended to be limited to the particular structures and methods disclosed herein, but should instead be gauged by the breadth of the claims which follow.

What is claimed is:

1. An apparatus comprising:

a circuit board having at least a first metal layer and a second metal layer, each said metal layer separated by an insulating layer;

said second metal layer overlapping said first metal layer in at least one region;

wherein said second metal layer has a monotonically decreasing width.

2. A circuit comprising:

a substrate having at lease a first metal layer and a second metal layer, each said metal layer separated by an insulating layer;

said second metal layer overlapping said first metal layer in at least one region;

wherein said second metal layer has a monotonically decreasing width.

* * * * *